US005322741A

United States Patent [19]

Uesugi et al.

[11] Patent Number: 5,322,741

[45] Date of Patent: Jun. 21, 1994

[54] ALUMINUM ALLOY SHEET WITH IMPROVED FORMABILITY AND METHOD OF PRODUCTION

[75] Inventors: Yasuji Uesugi; Koichi Hashiguchi; Yoshihiro Matsumoto; Makoto Imanaka; Takaaki Hira; Nobuyuki Morito; Yoichi Tobiyama; Nobuo Totsuka, all of Chiba; Motohiro Nabae, Tokyo, all of Japan

[73] Assignees: Toyota Motor Corporation; Kawasaki Steel Corporation; Furukawa Aluminum Co., all of Japan

[21] Appl. No.: 30,412

[22] PCT Filed: Jul. 22, 1992

[86] PCT No.: PCT/JP92/00931

§ 371 Date: Apr. 16, 1993

§ 102(e) Date: Apr. 16, 1993

[87] PCT Pub. No.: WO93/02225

PCT Pub. Date: Feb. 4, 1993

[30] Foreign Application Priority Data

| | | | |
|---|---|---|---|
| Jul. 22, 1991 | [JP] | Japan | 3-181335 |
| Jul. 22, 1991 | [JP] | Japan | 3-181338 |
| Sep. 2, 1991 | [JP] | Japan | 3-221877 |
| Sep. 2, 1991 | [JP] | Japan | 3-221878 |
| Feb. 21, 1992 | [JP] | Japan | 4-35409 |

[51] Int. Cl.[5] ..... B32B 15/20; C22F 1/04

[52] U.S. Cl. ..... 428/653; 428/650; 148/535; 148/537

[58] Field of Search ..... 428/632, 653, 650; 148/535, 537

[56] References Cited

U.S. PATENT DOCUMENTS

| | | | |
|---|---|---|---|
| 2,676,916 | 4/1954 | Zelley | 205/213 |
| 3,055,087 | 9/1962 | Fink | 428/650 |
| 3,551,122 | 12/1970 | Gulla | 428/650 |

FOREIGN PATENT DOCUMENTS

| | | | |
|---|---|---|---|
| 1119479 | 3/1982 | Canada | 428/650 |
| 0500015 | 8/1992 | European Pat. Off. . | |
| 49-32410 | 8/1974 | Japan | 428/650 |
| 61-157693 | 7/1986 | Japan | 428/650 |
| 2-19488 | 1/1990 | Japan | 428/650 |
| 3-146693 | 6/1991 | Japan | 428/650 |
| 2179058A | 2/1987 | United Kingdom | 428/650 |

OTHER PUBLICATIONS

Copy of European Search Report (6 pages), Jul. 28, 1993, for EP 92 91 6223.

*Primary Examiner*—John Zimmerman

*Attorney, Agent, or Firm*—Bierman and Muserlian

[57] ABSTRACT

The invention provides an aluminum alloy sheet having improved formability, an elongation of at least 30%, a sliding frictional resistance of up to 0.13 and minimized surface pressure dependency of sliding frictional resistance, comprising an aluminum alloy substrate containing at least 4 wt % of Mg and a Fe rich plating layer on a surface thereof in a coating weight of 1 to 50 g/m$^2$. Also provided is a bake hardenable, surface treated aluminum alloy sheet having improved formability, an elongation of at least 25%, a sliding frictional resistance of up to 0.13 and minimized surface pressure dependency of sliding frictional resistance, comprising a bake hardenable aluminum alloy substrate containing Mg and Si in an amount of at least 0.4 wt % calculated as $Mg_2Si$ and a Fe rich plating layer on a surface thereof in coating weight of 1 to 50 g/m$^2$. By forming a zincate layer as an undercoat below the Fe rich plating layer, the plating adhesion is further improved. The preferred Fe rich plating layer is a Fe-Zn alloy plating layer containing 20 to 80 wt % of Zn for corrosion resistance improvement. A Fe-Zn alloy plating layer containing 30 to 40 wt % of Zn meets both formability and corrosion resistance.

9 Claims, 5 Drawing Sheets

ALUMINUM ALLOY SHEET WITH IMPROVED FORMABILITY AND METHOD OF PRODUCTION

FIELD OF THE INVENTION

This invention relates to aluminum alloy sheets for primary use as automotive body panels and more particularly, to aluminum sheets or aluminum alloy sheets with improved press formability, especially bake hardenable, surface treated aluminum sheets or aluminum alloy sheets with improved press formability and a method for producing the same, and aluminum sheets or aluminum alloy sheets with improved press formability and corrosion resistance. Hereinafter, aluminum sheets and aluminum alloy sheets are generally designated aluminum alloy sheets.

PRIOR ART

From the standpoints of energy saving and the influence of carbon dioxide on the global environment, active efforts have been made for reducing the weight of automobiles. Among others, aluminum and aluminum alloys are highlighted for their advantages of material weight reductions and recycling and their use is increasing in these years.

However, aluminum alloy sheets have different properties from widely used conventional steel sheets and encounter many problems in applying them to automotive bodies. A typical problem is press forming. SPCC sheets as a typical steel sheet have an elongation of 45%, an r value of 1.4 and a limiting drawing ratio (LDR) as high as 2.15 whereas aluminum alloy sheets, for example, JIS A5182 sheets have only an elongation of 30%, an r value of 0.7 and a LDR as low as 1.8. Moreover aluminum alloy sheets of the bake hardenable type that heating for paint baking after press forming adds to strength are lower in formability as exemplified by JIS A6009-T4 sheets having an elongation of 25%, an r value of 0.7 and a LDR of 1.9. Since aluminum alloy sheets are very poor in formability, their application to automotive bodies is substantially restricted.

More specifically, actual application of aluminum alloy sheets to body panels was limited to light-forming members like hoods and their application to complex, heavy-forming members was difficult.

Since aluminum alloys were applied quite recently to automotive and analogous parts to be produced on a mass scale by press forming, no proposals or adequate means for solving the above-mentioned problems are available at present. The current manufacture is thus on progress with these problems unsolved. As a result, efforts to accomplish the social demand for automotive body weight reduction encounter difficulty. Investigating the press formability of aluminum alloy sheets, we found the fact that aluminum alloy sheets are significantly inferior in press formability to conventional cold rolled steel sheets because aluminum alloy sheets are not only poor in formability by themselves, but also experience greater sliding friction between their surface and the die used in press forming than the cold rolled steel sheets.

With the increased sliding friction, those portions of aluminum alloy sheets subject to severe sliding motion, for example, at beads of press dies for holding aluminum alloy sheets during press forming are prevented from smoothly entering the beads and can be ruptured in extreme cases. A comparison of optimum cushion pressure during press forming (the range of cushion pressure within which aluminum alloy sheets are not wrinkled or ruptured) between aluminum alloy sheets and cold rolled steel sheets reveals that aluminum alloy sheets have a significantly narrower range of optimum cushion pressure than cold rolled steel sheets so that the productivity of aluminum alloy sheets is low. It is thus strongly desired to improve the sliding frictional properties of aluminum alloy sheets.

It is believed that aluminum alloy sheets have poor sliding frictional properties because aluminum and aluminum alloys have a low melting point and high affinity to other metals, especially cast iron commonly used in press dies so that they are likely to stick to the dies.

Since sliding frictional properties upon press forming are largely affected by the physical properties of aluminum alloy sheets on the surface in direct contact with dies, it was attempted to improve sliding frictional properties by coating the aluminum alloy sheet surface with various metal platings or organic polymer coatings, for example, thereby avoiding direct contact between the aluminum alloy sheet surface and the die for imparting lubricity.

Further, lubricated aluminum alloy sheets thus far proposed include those sheets coated on the surface with a coating based on metal soap, higher fatty acid wax or the like.

These aluminum alloy sheets having platings and organic coatings, however, suffer from problems as mentioned below.

Aluminum alloy sheets having metal platings have the problem that since aluminum is an electrochemically strongly negative metal, metal platings other than zinc platings and zinc base platings containing a minor amount of an alloying element or elements in zinc can markedly deteriorate the corrosion resistance, especially unshielded corrosion resistance of aluminum alloy sheets. It is to be noted that zinc base platings can noticeably deteriorate press formability.

On the other hand, aluminum alloy sheets for use in automobiles, after press forming, are phosphated as a pretreatment prior to paint coating while the organic coating can partially remain on the aluminum alloy sheets without being completely dissolved away by alkaline degreasing prior to the phosphating. Such residual organic coating inhibits normal growth of phosphate crystals on aluminum alloy sheets during phosphating. As a result, the adhesion of paint coatings becomes low, which causes a lowering of corrosion resistance after paint coating.

Japanese Patent Application Kokai No. 172578/1989, though it relates to a different field, discloses a technique for improving the sliding frictional properties upon press forming of zinc system plated steel sheets by producing thereon an anhydrous alkali metal salt of an oxide of at least one metalloid selected from the group consisting of boron, phosphorus, silicon, selenium, antimony and tellurium. This technique, however, had the problem that since the anhydrous alkali metal salt of a metalloid oxide forms anhydrous crystals whose solubility is substantially lower than the solubility of hydrous crystals, the coating could not be completely dissolved away by alkaline degreasing treatment prior to phosphating and was partially left on aluminum alloy sheets, adversely affecting chemical conversion treatment as mentioned above.

DISCLOSURE OF THE INVENTION

An object of the present invention which has been made in consideration of the above-mentioned prior art is to provide an aluminum alloy sheet or aluminum alloy sheet which has significantly improved press formability over conventional aluminum or aluminum alloy sheets and which can be manufactured readily, stably and economically on a commercial basis.

Another object of the present invention is to provide a bake hardenable, surface treated aluminum alloy sheet which has significantly improved press formability over conventional aluminum or aluminum alloy sheets and which can be manufactured readily, stably and economically on a commercial basis and a method for preparing the same.

A further object of the present invention is to provide an aluminum alloy sheet having improved sliding frictional property which satisfies both press formability and corrosion resistance without detracting from the corrosion resistance and phosphating susceptibility thereof.

Making extensive investigations why aluminum alloy sheets, especially bake hardenable aluminum alloy sheets have poor press formability, we have found that properties as typified by the above-mentioned elongation property are substantially poor as compared with steel sheets and that aluminum alloy sheets show different sliding frictional behavior than steel sheets.

More particularly, an investigation on the dependence of coefficient of friction on surface pressure during sliding motion reveals that as shown in FIG. 1 or 4, steel sheets have low surface pressure dependence whereas aluminum alloy sheets are characterized by marked surface pressure dependence. Aluminum alloy sheets have an approximately equal coefficient of friction to steel sheets on a low surface pressure side, but as the surface pressure increases, aluminum alloy sheets decrease their coefficient of friction and the difference in coefficient of friction from steel sheets increases.

Making extensive investigations to improve the press formability of aluminum alloy sheets in the light of this finding, we have completed the present invention. More particularly, the present invention achieves substantial improvements in the press formability of aluminum alloy sheets by improving the elongation thereof and simultaneously providing iron rich platings on a surface thereof.

More specifically, the present invention provides an aluminum alloy sheet having improved formability, an elongation of at least 30%, a sliding friction of up to 0.13 and minimized surface pressure dependency of sliding friction, characterized by comprising an aluminum alloy substrate containing at least 4% by weight of Mg and a Fe rich plating layer on a surface thereof in coating weight or coating weight of 1 to 50 g/m$^2$.

In another form, the present invention provides a bake hardenable, surface treated aluminum alloy sheet having improved formability, an elongation of at least 25%, a sliding friction of up to 0.13 and minimized surface pressure dependency of sliding friction, characterized by comprising a bake hardenable aluminum alloy substrate containing Mg and Si an amount of at least 0.4 wt % calculated as $Mg_2Si$ and a Fe rich plating layer on a surface thereof in coating weight of 1 to 50 g/m$^2$.

In these forms of the invention, a zincate layer may be formed between the aluminum alloy substrate and the Fe rich plating layer as an undercoat for improving the adhesion of the Fe rich plating layer.

Additionally, the present invention provides a method for preparing a bake hardenable, surface treated aluminum alloy sheet having improved formability.

More specifically, the present invention provides a method for preparing a bake hardenable, surface treated aluminum alloy sheet having improved formability, an elongation of at least 25%, a sliding friction cf up to 0.13 and minimized surface pressure dependency of sliding friction, characterized by comprising the steps of annealing an aluminum alloy substrate containing Mg and Si in an amount of at least 0.4 wt % calculated as $Mg_2Si$ at a temperature of at least 480° C. and forming a Fe rich plating layer in coating weight of 1 to 50 g/m$^2$.

In another form, the present invention provides a method for preparing a bake hardenable, surface treated aluminum alloy sheet having improved formability, an elongation of at least 25%, a sliding friction of up to 0.13 and minimized surface pressure dependency of sliding friction, characterized by comprising the steps of forming a Fe rich plating layer in coating weight of 1 to 50 g/m$^2$ on an aluminum alloy substrate containing Mg and Si in an amount of at least 0.4 wt % calculated as $Mg_2Si$ and annealing at a temperature of at least 480° C.

We further investigated the relationship of coefficient of friction to press formability of aluminum alloy sheets. As a result, we have found that aluminum alloy sheets have a coefficient of friction of 0.15 or higher as opposed to conventional cold rolled steel sheets susceptible to press forming having a coefficient of friction of approximately 0.10. It is to be noted that the coefficient of friction used herein is a measurement by a draw bead drawing test with oil applied as will be described in Examples.

It was believed that aluminum alloy sheets have such a high coefficient of friction because the aluminum alloy has a low melting point and high affinity to other metals, especially cast iron commonly used in the press die so that the alloy is likely to stick to the die. Since the factor that affects sliding motion upon press forming is physical properties of aluminum alloy sheets on their surface in direct contact with the die, we investigated various metal platings to be formed on aluminum alloy sheets and lubricant coatings thereon for avoiding direct contact between the aluminum alloy sheet surface and the die. Consequently, we have found that the adequate Fe rich plating is a Fe-Zn plating and the preferred lubricant coating is of a certain inorganic compound.

More particularly, the Fe rich plating layer is preferably a Fe-Zn alloy plating layer containing 20 to 80 wt % of Zn, especially a Fe-Zn alloy plating layer containing 30 to 40 wt % of Zn.

For imparting lubricity, an inorganic compound may be applied on the Fe rich plating layer. The preferred inorganic compound is a hydrous alkali metal borate and has coating weight of 1 to 1,000 mg/m$^2$.

BEST MODE FOR CARRYING OUT THE INVENTION

The present invention is illustrated in further detail.

First, the aluminum alloy substrate used herein is described.

The aluminum alloy substrate which is plated in accordance with the present invention is one containing at least 4% by weight of Mg as an additive element for the reason described later. Also, the bake hardenable surface treated aluminum alloy substrate which is plated in accordance with the present invention is one containing Mg and Si as additive elements in an amount of at least 0.4 wt % calculated as $Mg_2Si$ for the reason described later.

The iron rich plating layer containing Fe as a major component which is applied to the aluminum alloy substrate according to the present invention encompasses Fe plating, Fe-P plating, Fe-C plating, Fe-B plating, Fe-Zn alloy plating, Fe-Ni alloy plating and other Fe alloy platings. Any of plating means including electroplating, chemical plating, vapor deposition and cladding may be used and the plating means is not particularly limited.

In order to improve the adhesion between the aluminum alloy substrate and the iron rich plating layer, a zincate layer may be provided between the aluminum alloy substrate and the Fe rich plating layer as an undercoat underlying the Fe rich plating layer. The zincate layer forming an undercoat underlying the Fe rich plating layer may be any of Zn, Zn-Ni, Zn-Fe, Zn-Ni-Cu and the like.

Figure 1:
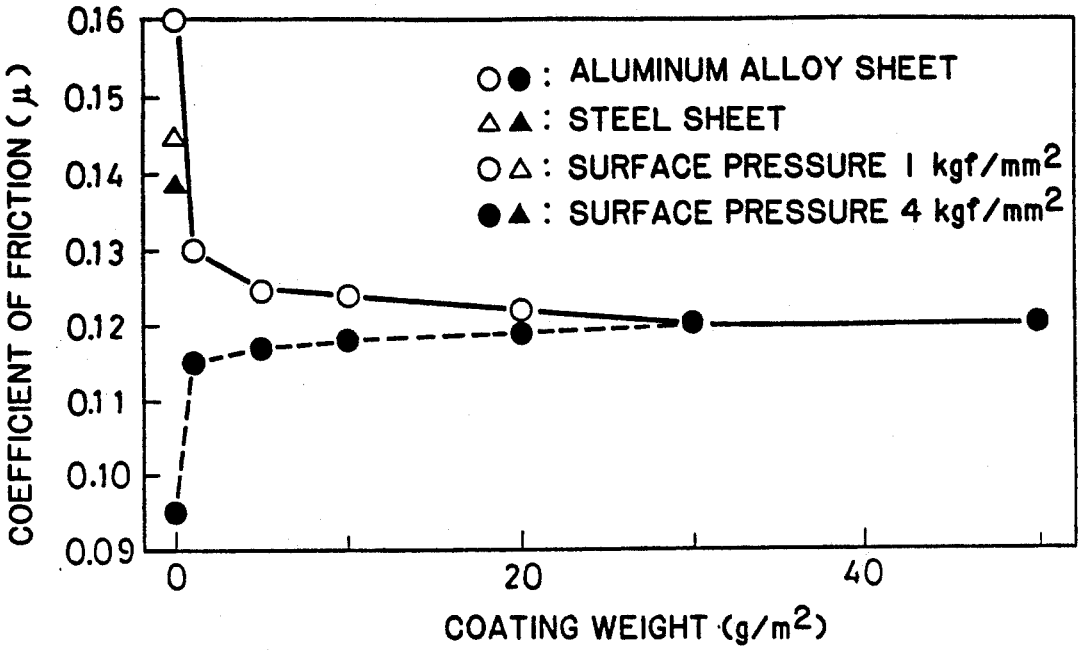
FIG. 1 is a graph showing the influence of Fe-P coating weight and surface pressure on the coefficient of friction of aluminum alloy sheets when aluminum alloy substrates containing 5.5% Mg are used.

When it is desired to improve the press formability of an aluminum or aluminum alloy substrate by applying a Fe rich plating to a surface thereof, it is seen from FIG. 1 that the surface pressure dependency of coefficient of friction is reduced when the iron rich plating is applied in coating weight of at least 1 g/m$^2$ to provide a coefficient of friction of 0.13 or less. Since coating weight in excess of 50 g/m$^2$ attain no further improvements and are economical wastes of source materials and energy, the preferred coating weight of the Fe rich plating is from 1 to 50 g/m$^2$. It is also seen from FIG. 2 that even with a coefficient of friction of 0.13 or less, aluminum alloy substrates having low elongation insufficiently improve in formability. Therefore, the stock material should have an elongation of at least 30% and it is evident from FIG. 3 that the Mg content in the aluminum alloy substrate should be at least 4% by weight in order to insure an elongation of at least 30%.

Figure 4:
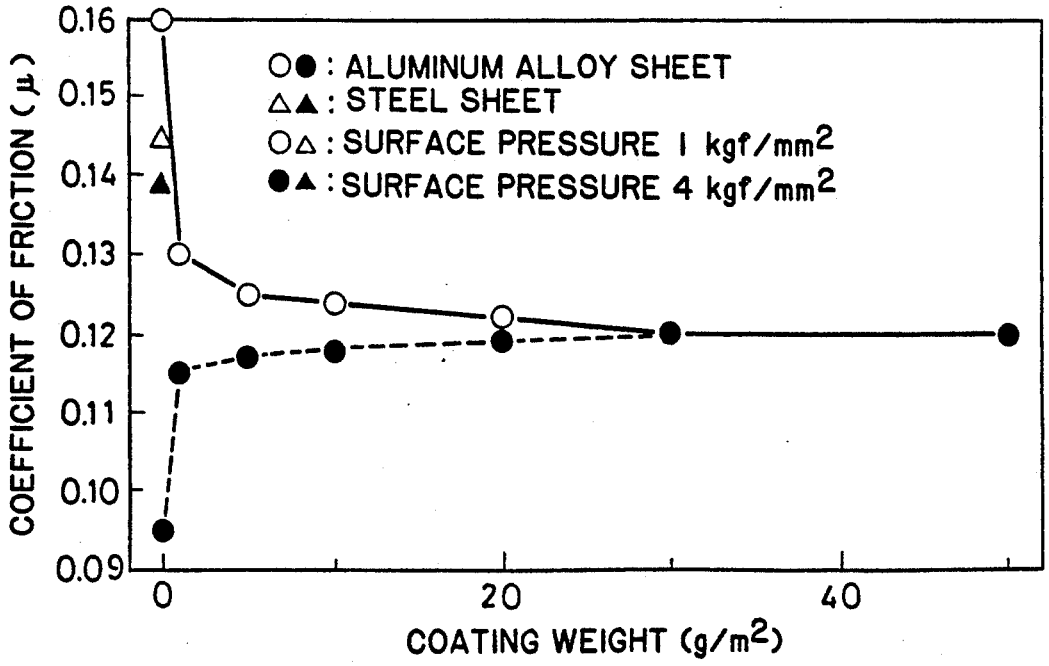
FIG. 4 is a diagram showing the influence of surface pressure upon sliding when aluminum alloy substrates containing 0.63% of $Mg_2Si$ and annealed at 560° C. are used, in comparison with the influence of surface pressure on the coefficient of friction of steel sheets.

In the manufacture of bake hardenable, surface treated aluminum alloy sheets, when it is desired to improve the press formability of an aluminum alloy substrate by applying a Fe rich plating to a surface thereof, it is seen from FIG. 4 that the surface pressure dependency of coefficient of friction is reduced when the iron rich plating is applied in coating weight of at least 1 g/m$^2$ to provide a coefficient of friction of 0.13 or less. Since coating weight in excess of 50 g/m$^2$ attain no further improvements and are economical wastes of source materials and energy, the preferred coating weight of the iron rich plating is from 1 to 50 g/m$^2$. It is also seen from FIG. 5 that even with a coefficient of friction of 0.13 or less, aluminum alloy substrates having low elongation insufficiently improve in formability. Therefore, the stock material should have an elongation of at least 25%.

With respect to bake hardenability, it is desired to accomplish a change in strength of at least 7 kgf/mm$^2$ before and after heating at 180° C. for 60 minutes. To this end, a $Mg_2Si$ content of at least 0.4% by weight is necessary. This $Mg_2Si$ content must be present in solid solution form during press forming and precipitate as $Mg_2Si$ upon heating, means for causing Mg and Si to form a solid solution is to heat at a temperature of 480° C. or higher, and this heating may be done either before or after the Fe rich plating.

The Fe rich plated aluminum alloy sheet or Fe rich plated bake hardenable aluminum alloy sheet of the above-mentioned construction exhibits significantly improved formability over conventional aluminum alloy sheets so that it can be implemented as parts of complex shape to be heavily formed. It is to be noted that as seen from FIG. 7, plating layer stripping which can occur on heavy forming can be suppressed by providing a zincate layer as an undercoat as compared with an iron rich plating layer being solely provided. Less coating weight of the zincate layer are preferred. In the embodiment having a surface layer consisting of a zincate layer and a Fe rich plating layer, the coating weight of Fe rich plating layer should preferably be in the range of 3 to 20 g/m$^2$ because plating adhesion is low with coating weight of less than 3 g/m$^2$ or more than 20 g/m$^2$.

We have found that among Fe rich platings, Fe-Zn alloy plating can satisfy both sliding frictional property and corrosion resistance in addition to formability. This is described below.

Applying various metal platings on a surface of aluminum alloy sheets in order to solve the aforementioned problems of aluminum alloy sheets, we searched for the alloy plating that can satisfy both sliding frictional property and corrosion resistance. Then we have found that Fe-Zn alloy platings containing less than 20% by weight of Zn as a plating layer forming a surface layer are effective for improving the press formability of aluminum alloy sheets, but significantly deteriorate corrosion resistance, especially unshielded corrosion resistance. On the other hand, Fe-Zn alloy platings containing more than 80% by weight of Zn do not adversely affect the corrosion resistance of aluminum alloy sheets, but render press formability poorer than the aluminum alloy substrates. Differently stated, it has been found that Fe-Zn alloy platings should have a Zn content of 20 to 80% by weight in order to satisfy both sliding frictional property and corrosion resistance.

It is believed that this behavior reflects the following fact. Fe-Zn alloy platings having a Zn content of less than 20% by weight have physical properties approximate to those of Fe single phase plating, and they are thus effective for improving press formability because of high hardness and melting point, but allow more aluminum to be leached out from plating defects to produce deep pitting corrosion because of their extremely more positive electrochemical potential than aluminum. On the other hand, Fe-Zn alloy platings having a Zn content of more than 80% by weight have physical properties approximate to those of Zn single phase plating and hence, an electrochemical potential equal to or more negative than aluminum, and consequently, they cease to cause corrosion of the underlying aluminum alloy substrate. However, press formability becomes poorer than aluminum alloy substrates themselves since zinc has a lower melting point and hardness and is more likely to stick to press dies than aluminum. It is to be noted that the coating weight and plating means of Fe-Zn alloy plating are as previously mentioned.

Figure 9:
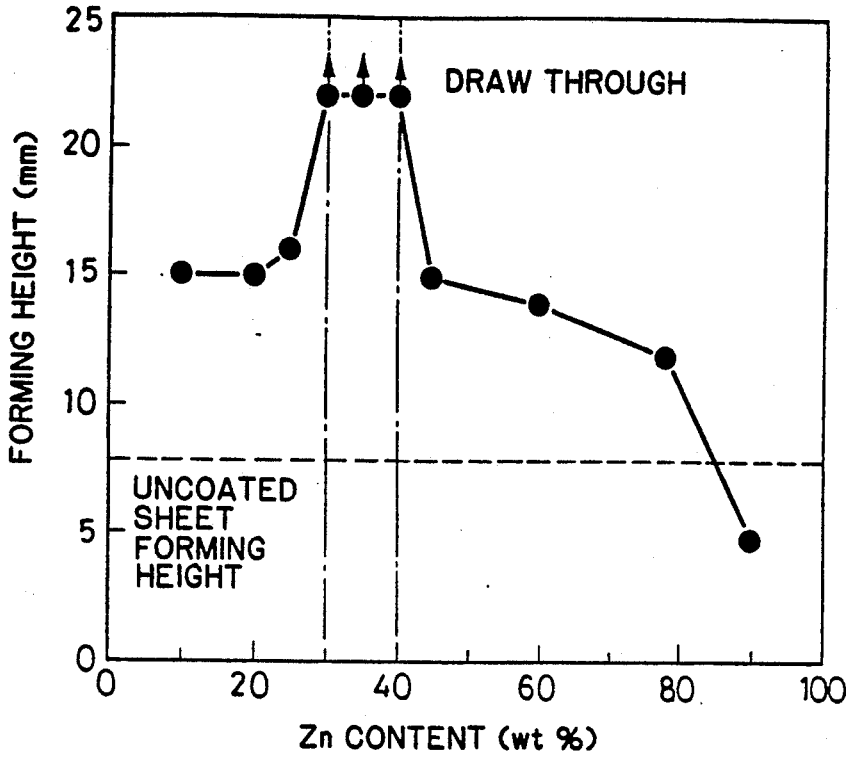
FIG. 9 is a diagram showing forming height relative to the Zn content of Fe rich platings.
Figure 10:
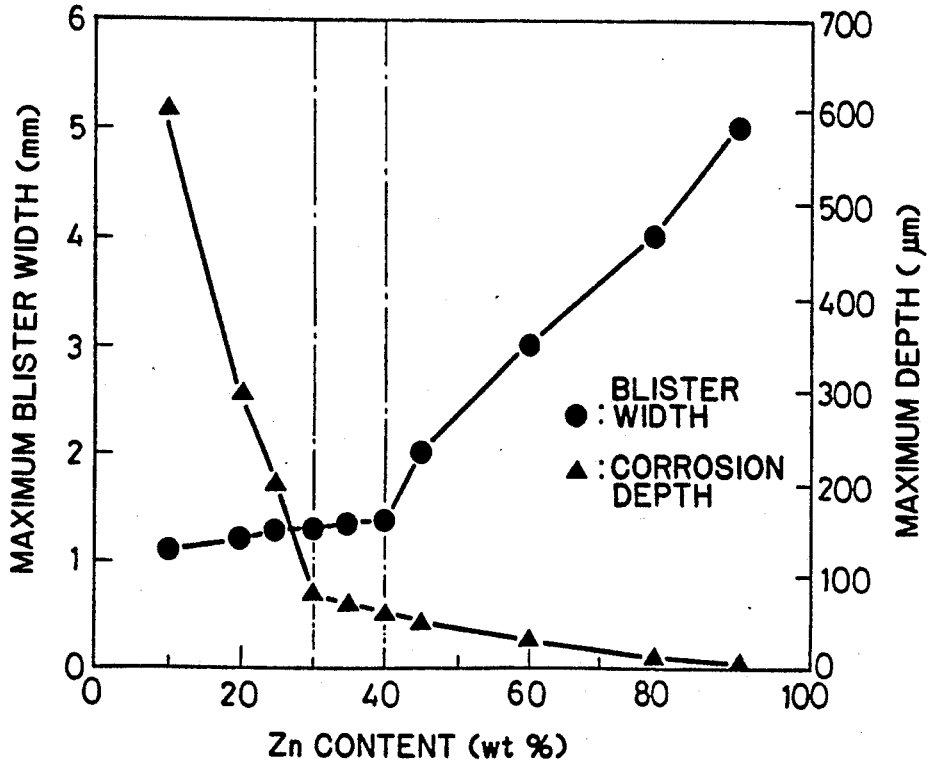
FIG. 10 is a diagram showing paint coating blister and maximum corrosion depth relative to the Zn content of Fe rich platings.

Continuing investigations on Fe-Zn alloy plating, we have further found that better results are obtained when formability and corrosion resistance are related in a specific range as shown in Example 5 and FIGS. 9 and 10. More particularly, Fe-Zn alloy platings exhibit excellent formability and corrosion resistance with Zn contents of 30 to 40 wt %.

Further continuing investigations in order to improve the sliding frictional property of Fe rich plated aluminum alloy sheets, we have found it effective to form an inorganic compound layer on a Fe rich plating layer. This is described below.

Making investigation and research on the surface treating method for significantly improving the sliding frictional property of aluminum alloy sheets without detracting from corrosion resistance for the purpose of solving the aforementioned problems of aluminum alloy sheets, we have found that aluminum alloy sheets having a Fe rich plating layer as typified by a Fe-Zn alloy plating layer on a surface thereof and an inorganic compound as an overcoat layer thereon are preferred. We have also found that particularly when an aluminum alloy substrate is provided with a Fe-Zn alloy plating layer having a Zn content of 20 to 80% by weight, especially 30 to 40% by weight and an inorganic substance, typically an alkali metal borate containing water of crystallization as an overcoat layer thereon, both the coatings cooperate to provide a synergistic effect of markedly improving the sliding frictional property of the aluminum alloy sheet without detracting from corrosion resistance.

The reason why the Fe-Zn alloy plating layer having a specific component content and an inorganic substance such as an alkali metal borate are effective for improving the sliding frictional property of the aluminum alloy sheet without detracting from corrosion resistance is presumed as follows.

We have found that Fe-Zn alloy plating layers having a Zn content of less than 20% by weight are effective for improving the press formability, but detract from the corrosion resistance, especially unshielded corrosion resistance of aluminum alloy sheets and that Fe-Zn alloy plating layers having a Zn content in excess of 80% by weight do not deteriorate the corrosion resistance of aluminum alloy sheets, but make press formability poorer than aluminum alloy substrates. Differently stated, in order that aluminum alloy sheets meet both press formability and corrosion resistance, Fe-Zn alloy plating layers should have a Zn content of 20 to 80% by weight.

It is believed that this behavior reflects the following fact. Fe-Zn alloy platings having a Zn content of less than 20% by weight have physical properties approximate to those of Fe single phase plating, and they are thus effective for improving press formability because of high hardness and melting point, but allow more aluminum to be leached out from plating defects to produce deep pitting corrosion because of their extremely more positive electrochemical potential than aluminum. On the other hand, Fe-Zn alloy platings having a Zn content of more than 80% by weight have physical properties approximate to those of Zn single phase plating and hence, an electrochemical potential equal to or more negative than aluminum, and consequently, they cease to cause corrosion of the underlying aluminum alloy substrate. However, press formability becomes poorer than aluminum alloy substrates themselves since zinc has a lower melting point and hardness and is more likely to stick to press dies than aluminum.

On the other hand, where a coating of an inorganic substance is formed to a predetermined coating weight by applying an aqueous solution of the inorganic substance such as alkali metal borate to aluminum alloy sheets followed by heat drying, not only a Fe-Zn alloy plating layer having a Zn content of 20 to 80% by weight on the aluminum alloy sheet surface is effective for improving sliding frictional property, but the overlying layer of alkali metal borate or the like forms a tough coating of network structure having lubricity, and they cooperate to provide a synergistic effect of significantly improving sliding frictional property.

The inorganic compound must be effective for reducing a coefficient of friction when present on a Fe-Zn alloy plated aluminum alloy sheet, and mostly dissolved away by water washing or alkaline degreasing in the phosphating step subsequent to the press forming step. Any of the inorganic compounds which satisfy these requirements can be used.

Particularly preferred examples of the inorganic compound used herein include borates, carbonates, phosphates, sulfates, nitrates, chlorides, hydroxides and oxides of alkali metals such as Na and K, alkaline earth metals such as Ca and Mg, and metals or metalloids such as Fe, Ni, Co, Al, Ti and Si.

The aluminum alloy sheet of the invention is readily prepared by contacting the aluminum alloy sheet on the Fe-Zn alloy plating layer with an aqueous solution of an inorganic substance followed by drying as will be described later. Therefore, from the standpoint of manufacture, the inorganic compound is required to be water soluble. From the standpoint of cost, less expensive ones are preferred. Additionally, the inorganic compound should preferably be well soluble in water or basic aqueous solution since it must be dissolved away by water washing or alkaline degreasing in the aluminum alloy sheet processing.

With these points taken into account, alkali metal salts are especially preferred among the aforementioned inorganic compounds. Especially effective for improving sliding frictional property are alkali metal borates. Examples suitable for practical use are sodium, potassium and lithium salts of metaboric acid, tetraboric acid and pentaboric acid.

It will be understood that these alkali metal borates are either hydrous or anhydrous although inorganic compounds in hydrous crystal form on the aluminum alloy sheet are more advantageously dissolved away during water washing or alkaline degreasing.

A typical example of the hydrous alkali metal borate is borax (sodium tetraborate $Na_2B_4O_7.10H_2O$) which can be commercially produced on a mass scale and is inexpensive.

The form of the inorganic compound on the aluminum alloy sheet is not particularly limited in the present invention and includes coating and fine particulate forms.

The coating weight of the hydrous alkali metal borate coating to be formed on a Fe-Zn alloy plated aluminum alloy sheet is limited to the range of 1 to 1,000 mg/m$^2$ according to the present invention for the following reason. Coating weight of less than 1 mg/m$^2$ are not effective for improving sliding frictional property whereas with coating weight in excess of 1,000 mg/m$^2$, sliding frictional behavior improvement is saturated and the coating can not be completely removed in the degreasing step prior to phosphating so that part would remain on the plating, adversely affecting the subsequent phosphating.

Fe-Zn alloy plating is generally followed by drying and aluminum alloy sheets immediately after drying are at high temperatures. Then by spraying an aqueous solution of an inorganic compound such as alkali metal borate as mentioned above to the aluminum alloy sheets while they are at temperatures in the range of 60° to 200° C., thereby bringing the aqueous solution in mist form into contact with the aluminum alloy sheet, a coating can be prepared at a markedly reduced cost, the resultant coating being of the same quality as coatings which are prepared by contacting the aluminum alloy sheet with the aqueous solution at room temperature followed by heat drying.

Examples of the present invention are given below by way of illustration.

EXAMPLE 1

Figure 2:
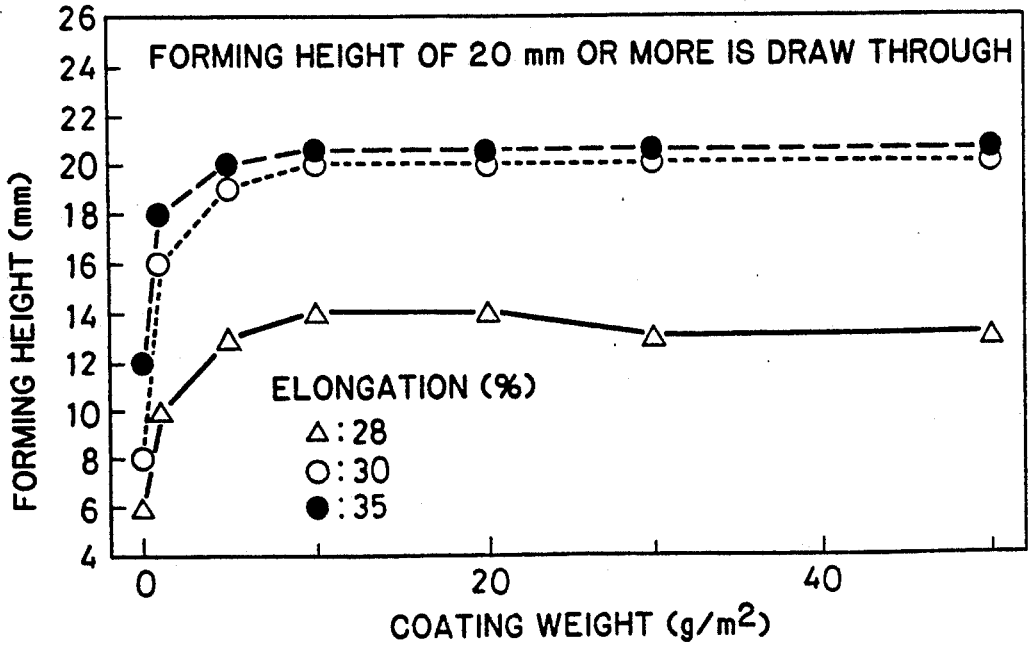
FIG. 2 is a graph showing the influence of elongation and Fe-P coating weight on the cup forming height of aluminum alloy sheets when aluminum alloy substrates containing 5.5% Mg are used.
Figure 3:
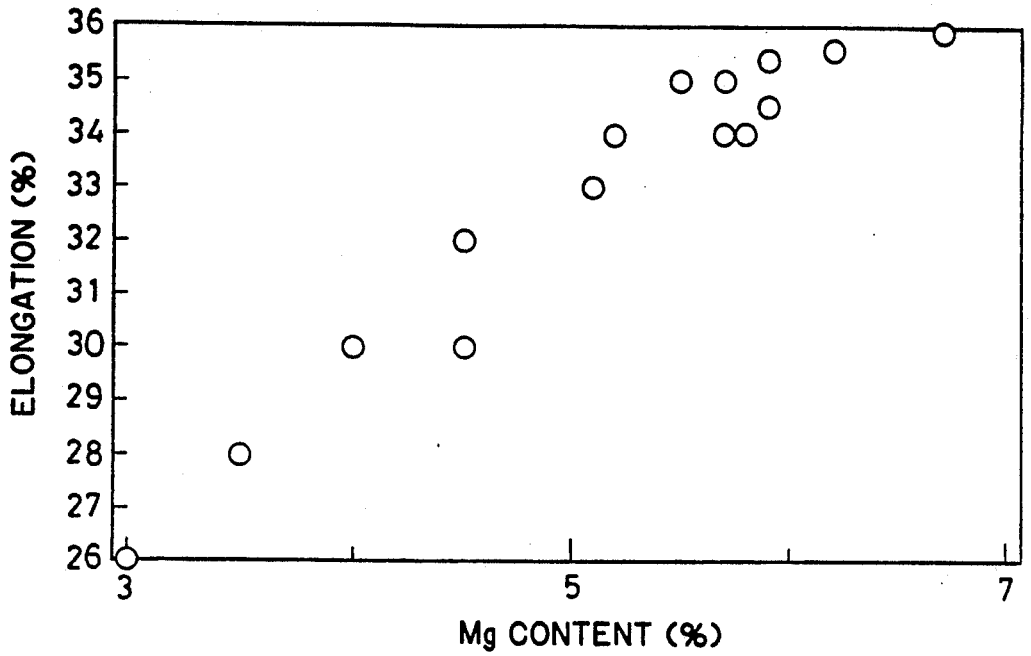
FIG. 3 is a graph showing the influence of Mg content on the elongation of aluminum alloy sheets.

Aluminum sheets, that is, aluminum alloy sheets having a Mg content of 4.5% and 5.5% and an elongation of 30% and 35%, respectively, and a comparative aluminum alloy sheet containing 3.5% of Mg (elongation 28%) which was a typical aluminum alloy sheet used as an automotive body material (all gage 1.0 mm) were coated with Fe rich platings as shown in Table 1. These materials were measured for a coefficient of friction and separately subjected to cup forming. The results are shown in Table 1. The influence of the Fe-P coating weight and the surface pressure upon sliding on the coefficient of friction of the 5.5% Mg material is shown in FIG. 1 in comparison with the influence of surface pressure on the coefficient of friction of a steel sheet (SPCC, gage 1.0 mm). The influence of the Fe-P coating weight on the cup forming height of the three types of aluminum alloy sheets is shown in FIG. 2 and the influence of Mg contents on the elongation of aluminum alloy sheet (gage 1.0 mm) is shown in FIG. 3.

Coefficient of friction measuring test: A flat plate was slid with low viscosity oil applied.

Cup forming: Using a cylindrical punch with 50 mm diameter and a blank with 100 mm diameter, the forming height at rupture was measured with low viscosity oil applied.

TABLE 1

| Mg Forming (%) | Elongation (%) | Plating Type | Plating Coating weight | Coefficient of friction | Forming height (mm) | Remarks |
|---|---|---|---|---|---|---|
| 3.5 | 28 | none | | 0.16 | 6 | Comparison |
| 3.5 | 28 | Fe-0.1% P | 5 g/m$^2$ | 0.12 | 13 | Comparison |
| 4.5 | 30 | none | | 0.16 | 8 | Comparison |
| 4.5 | 30 | Fe-0.1% P | 5 g/m$^2$ | 0.12 | >20 draw through | Invention |
| 4.5 | 30 | Fe-20% Zn | 5 g/m$^2$ | 0.12 | >20 draw through | Invention |
| 5.5 | 35 | none | | 0.16 | 12 | Comparison |
| 5.5 | 35 | Fe-0.1% P | 5 g/m$^2$ | 0.115 | >20 draw through | Invention |
| 5.5 | 35 | Fe-20% Zn | 5 g/m$^2$ | 0.125 | >20 draw through | Invention |
| 5.5 | 35 | Fe-0.1% C | 5 g/m$^2$ | 0.12 | >20 draw through | Invention |

EXAMPLE 2

Figure 5:
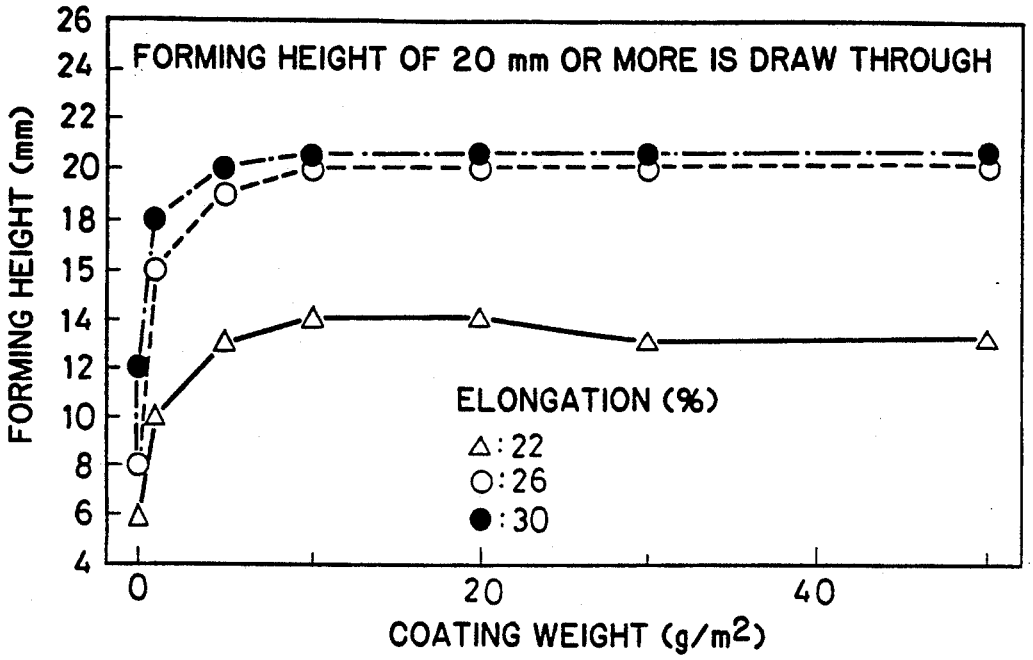
FIG. 5 is a diagram showing the influence of Fe-P coating weight on the cup forming height of aluminum alloy sheets when aluminum alloy substrates containing 0.63% of $Mg_2Si$ and annealed at 450° C. (elongation 22%), 500° C. (elongation 26%), or 550° C. (elongation 30%) are used.
Figure 6:
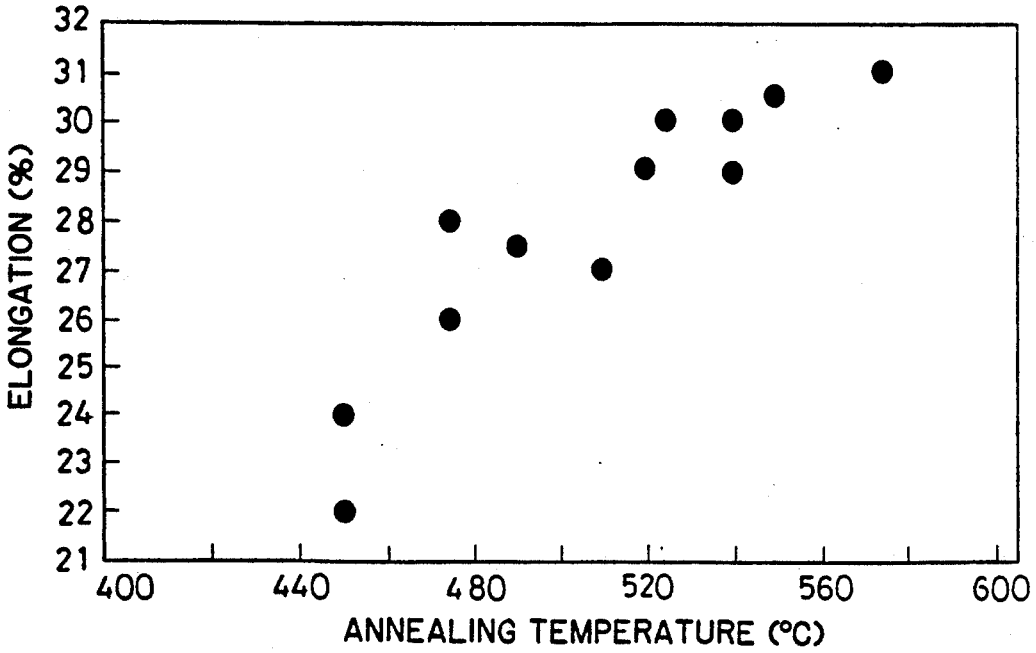
FIG. 6 is a diagram showing the influence of annealing temperature on the elongation of aluminum alloy sheets when aluminum alloy substrates containing 0.63% of $Mg_2Si$ are used.

Aluminum alloy sheets containing 0.4% Mg and 0.8% Si (Al-0.63% $Mg_2Si$-0.57% Si) as test samples were annealed at 450° C. (elongation 22%) as comparative samples, annealed at 500° C. (elongation 26%) or annealed at 550° C. (elongation 30%). These aluminum alloy sheets (all gage 1.0 mm) were coated with Fe rich platings as shown in Table 2. Also aluminum alloy sheets containing 0.2% Mg and 0.4% Si (Al-0.31% $Mg_2Si$-0.28% Si) as comparative samples were annealed at 500° C. (elongation 28%) and similarly coated with iron rich platings. These materials were measured for a coefficient of friction and separately subjected to cup forming. The results are shown in Table 2. Bake hardenability was determined by heating the test samples at 180° C. for 60 minutes and measuring a change of strength before and after the heating by a tensile test, with the results shown in Table 2. The influence of the Fe-P coating weight and the surface pressure upon sliding on the coefficient of friction of the 560° C.-annealed samples is shown in FIG. 4 in comparison with the influence of the surface pressure on the coefficient of friction of steel sheets (SPCC, gage 1.0 mm). The influence of the Fe-P coating weight on the cup forming height of these aluminum alloy sheets is shown in FIG. 5 and the influence of annealing temperature on the elongation of aluminum alloy sheets (gage 1.0 mm) is shown in FIG. 6.

Coefficient of friction measuring test: A flat plate was slid with low viscosity oil applied.

Cup forming: Using a cylindrical punch with 50 mm diameter and a blank with 100 mm diameter, the forming height at rupture was measured with low viscosity oil applied.

Figure 7:
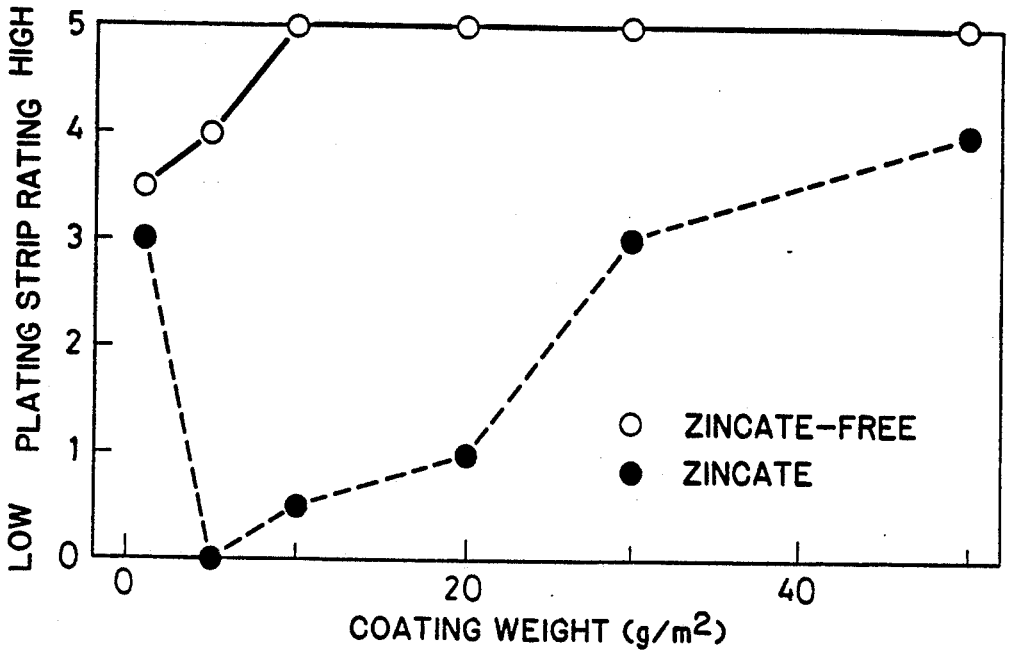
FIG. 7 is a graph showing the influence of a zincate layer and its coating weight on the adhesion to platings of aluminum alloy sheets when aluminum alloy substrates containing 5.5% Mg are used.

Tensile test: Using a JIS No. 5 specimen prescribed in JIS Z2201, a tensile test was carried out at a pulling rate of 10 mm/min. in accordance with JIS Z2241 for measuring tensile strength.

ing weight on the cup forming height of the three types of aluminum alloy sheets is shown in FIG. 2, the influence of Mg contents on the elongation of aluminum alloy sheet (gage 1.0 mm) is shown in FIG. 3, and the plating adhesion to the 5.5% Mg aluminum alloy sheets is shown in FIG. 7. The plating adhesion was determined after a sliding test at a surface pressure of 4 kgf/mm$^2$ by applying adhesive tape to the sliding surface, stripping the tape and evaluating the degree of blackening of the tape among ratings of 0 to 5. The higher the ratings, the more stripping and more blackening occurred.

Coefficient of friction measuring test: A flat plate was slid with low viscosity oil applied.

Cup forming: Using a cylindrical punch with 50 mm diameter and a blank with 100 mm diameter, the forming height at rupture was measured with low viscosity oil applied.

TABLE 2

| $Mg_2Si$ content (wt %) | Anneal temp. (°C.) | Elongation (%) | Plating Type | Plating Coating weight | Coefficient of friction | Forming height (mm) | Strength change (kgf/mm$^2$) | Remarks |
|---|---|---|---|---|---|---|---|---|
| 0.63 | 450 | 22 | none | | 0.16 | 4 | 7 | Comparison |
| 0.63 | 450 | 22 | Fe-0.1% P | 5 g/m$^2$ | 0.12 | 10 | 7 | Comparison |
| 0.63 | 500 | 26 | none | | 0.16 | 6 | 9 | Comparison |
| 0.63 | 500 | 26 | Fe-0.1% P | 5 g/m$^2$ | 0.12 | >20 draw through | 9 | Invention |
| 0.63 | 500 | 26 | Fe-20% Zn | 5 g/m$^2$ | 0.12 | >20 draw through | 9 | Invention |
| 0.63 | 550 | 30 | none | | 0.16 | 8 | 12 | Comparison |
| 0.63 | 550 | 30 | Fe-0.1% P | 5 g/m$^2$ | 0.115 | >20 draw through | 12 | Invention |
| 0.63 | 550 | 30 | Fe-20% Zn | 5 g/m$^2$ | 0.125 | >20 draw through | 12 | Invention |
| 0.63 | 550 | 30 | Fe-0.1% P | 5 g/m$^2$ | 0.12 | >20 draw through | 12 | Invention |
| 0.31 | 500 | 28 | none | | 0.16 | 7 | 5 | Comparison |
| 0.31 | 500 | 28 | Fe-0.1% P | 5 g/m$^2$ | 0.12 | >20 draw through | 5 | Comparison |

EXAMPLE 3

TABLE 3

| Mg content (%) | Elongation (%) | Plating Zincate type | Plating Type | Coating weight | Coefficient of friction | Forming height (mm) | Remarks |
|---|---|---|---|---|---|---|---|
| 3.5 | 28 | none | none | | 0.16 | 6 | Comparison |
| 3.5 | 28 | Zn | Fe-0.1% P | 5 g/m$^2$ | 0.12 | 13 | Comparison |
| 4.5 | 30 | none | none | | 0.16 | 8 | Comparison |
| 4.5 | 30 | Zn—Ni | Fe-0.1% P | 5 g/m$^2$ | 0.12 | >20 draw through | Invention |
| 5.5 | 35 | none | none | | 0.16 | 12 | Comparison |
| 5.5 | 35 | Zn—Ni | Fe-0.1% P | 5 g/m$^2$ | 0.115 | >20 draw through | Invention |
| 5.5 | 35 | Zn | Fe-20% Zn | 5 g/m$^2$ | 0.125 | >20 draw through | Invention |
| 5.5 | 35 | Zn—Fe | Fe-0.1% C | 5 g/m$^2$ | 0.12 | 20 draw through | Invention |

Aluminum sheets, that is, aluminum alloy sheets having a Mg content of 4.5% and 5.5% and an elongation of 30% and 35%, respectively, and a comparative aluminum alloy sheet containing 3.5% of Mg (elongation 28%) which was a typical aluminum alloy sheet used as an automotive body material (all gage 1.0 mm) were coated with Fe rich platings as shown in Table 3. These materials were measured for a coefficient of friction and separately subjected to cup forming. The results are shown in Table 3. The influence of the Fe-P coating weight and the surface pressure upon sliding on the coefficient of friction of the 5.5% Mg material is shown in FIG. 1 in comparison with the influence of surface pressure on the coefficient of friction of a steel sheet (SPCC, gage 1.0 mm). The influence of the Fe-P coat-

EXAMPLE 4

(1) Preparation of samples

Aluminum alloy sheets according to JIS A5182 were primed with zinc replacement plating by a zincate method and then coated with Fe-Zn alloy platings having varying coating weight and Zn content by an electrodeposition method.

(2) Evaluation test methods

Evaluation tests were carried out as follows, with the results shown in Table 4.

a) Sliding frictional property (press formability)

Figure 8A:
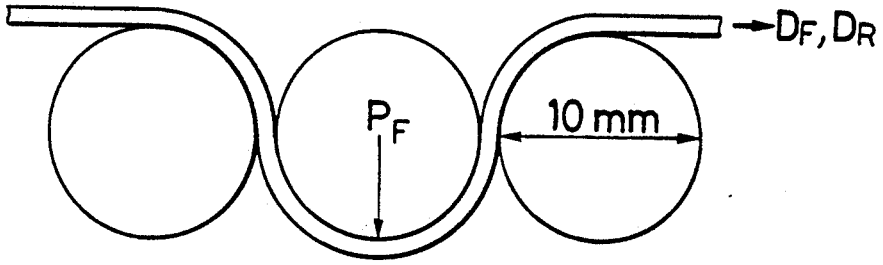
FIG. 8 schematically illustrates how to evaluate sliding frictional property, FIG. 8*a* being a schematic view of a draw bead drawing type sliding test machine and FIG. 8*b* illustrating the analysis by this test machine.
Figure 8B:
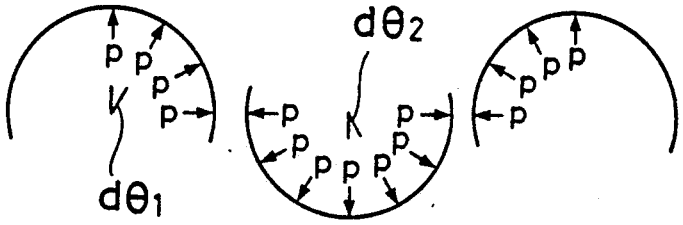

Sliding frictional property was evaluated by a draw bead drawing test as shown in FIGS. 8*a* and 8*b*.

More particularly, the sliding frictional property of a sample was evaluated by measuring the force $D_F$ required to draw the sample with the rolls kept fixed and the force $D_R$ required to draw the sample with the rolls allowed to rotate in FIG. 8, and calculating the coefficient of friction $\mu$ of the sample from these measurements in accordance with the following formulae.

$$D_F - D_R = 2\mu p \int_0^{\pi/2} R d\theta_1 + \mu p \int_{-\pi/2}^{\pi/2} d\theta_2$$

$$= 2\pi\mu p R$$

$$P_F = 2p \int_{-\pi/2}^{\pi/2} R\cos\theta_2 d\theta_2 = 2pR$$

Thus, $\mu = (D_F - D_R)/(\pi P_F)$ wherein $\mu$: coefficient of friction between roll and sample,
P: force applied radially of the roll,
R: roll radius,
$\theta$: central angle,
$P_F$: pressing load on center punch.

The test conditions are given below.

Sample size: 20×400 mm
Sliding speed: 500 mm/sec.
Sliding distance: 100 mm
Pressing load on center punch: 100 kgf
Cleaning oil: 0.5 g/m² oil application The samples were evaluated in accordance with a coefficient of friction with the following ratings.

O: $\mu$ up to 0.13
X: $\mu$ greater than 0.13 b) Corrosion resistance

Aluminum alloy sheets having Fe-Zn alloy plated thereon were subjected to a salt spray test in accordance with JIS Z2371 for 3 months before the surface oxide was removed from the samples with 30 wt % nitric acid for measuring the maximum corrosion depth. Evaluation was made in accordance with the following criterion.

○: maximum corrosion depth less than 0.1 mm
X: maximum corrosion depth 0.1 mm or more

TABLE 4

| No. | Zn content (wt %) | Coating weight (g/m²) | Coefficient of friction | Corrosion resistance | Remarks |
|---|---|---|---|---|---|
| 1 | 20 | 1 | ○ | ○ | Invention |
| 2 | 20 | 5 | ○ | ○ | Invention |
| 3 | 20 | 25 | ○ | ○ | Invention |
| 4 | 20 | 50 | ○ | ○ | Invention |
| 5 | 50 | 1 | ○ | ○ | Invention |
| 6 | 50 | 5 | ○ | ○ | Invention |
| 7 | 50 | 25 | ○ | ○ | Invention |
| 8 | 50 | 50 | ○ | ○ | Invention |
| 9 | 80 | 1 | ○ | ○ | Invention |
| 10 | 80 | 5 | ○ | ○ | Invention |
| 11 | 80 | 25 | ○ | ○ | Invention |
| 12 | 80 | 50 | ○ | ○ | Invention |

TABLE 4-continued

| No. | Zn content (wt %) | Coating weight (g/m²) | Coefficient of friction | Corrosion resistance | Remarks |
|---|---|---|---|---|---|
| 13 | 18 | 10 | ○ | X | Comparison |
| 14 | 40 | 0.8 | X | ○ | Comparison |
| 15 | 82 | 10 | X | ○ | Comparison |

EXAMPLE 5

Aluminum alloy sheets according to JIS A5182 were primed with zinc replacement plating by a zincate method and then coated with Fe-Zn alloy platings having varying coating weight and Zn content by an electrodeposition method. The following tests were carried out, with the results shown in Table 5.

1) Press forming test

After 0.5 g/m² of cleaning oil was applied to a surface, a sample was punched to a diameter of 68 mm and then subjected to high speed cylindrical drawing with a diameter of 33 mm at a working rare of 500 mm/sec. Formability was evaluated in accordance with the following criteria.

○○: forming height 20 mm or more (inclusive of drawing through)
○: forming height 10–19 mm
X: forming height less than 10 mm With a coating weight of 10 g/m², the formability changed as shown in FIG. 9.

2) Corrosion resistance test

After plating, a sample (70×150 mm) was subjected to phosphating and cationic electro coating of 20 μm. Using a cutter knife, the coated sample was scribed to define cross-cuts deep to the substrate and then subjected to a salt spray test in accordance with JIS Z2371 for 3 months. For the test sample, the maximum coating blister width from the cuts was measured, and the coating and surface oxide were removed for measuring the maximum corrosion depth at and in proximity to the cross-cuts. Corrosion resistance was evaluated in accordance with the following criteria.

Coating blister

○: maximum blister width up to 2 mm
X: maximum blister width in excess of 2 mm

Corrosion depth

○: maximum depth up to 100 μm
X: maximum depth in excess of 100 μm

With a coating weight of 10 g/m², the blister width and corrosion depth changed as shown in FIG. 10.

As seen from these results, formability is excellent with a Zn content of 30 to 40%, the coating blister becomes increased with Zn contents in excess of 40%, and the maximum depth becomes significantly increased with Zn contents of less than 30%. It is thus evident that there exists a specific range of Zn content for formability and corrosion resistance in that they are extremely improved with Zn contents of 30 to 40%.

TABLE 5

| | Plating | | | Corrosion resistance | | |
|---|---|---|---|---|---|---|
| No. | Zn content (wt %) | Coating weight (g/m²) | Formability | Coating blister | Corrosion depth | Remarks |
| 1 | 25 | 1 | ○ | ○ | X | Comparison |

TABLE 5-continued

| No. | Plating: Zn content (wt %) | Plating: Coating weight (g/m²) | Formability | Corrosion resistance: Coating blister | Corrosion resistance: Corrosion depth | Remarks |
|---|---|---|---|---|---|---|
| 2 | 25 | 5 | ○ | ○ | X | Comparison |
| 3 | 25 | 25 | ○ | ○ | X | Comparison |
| 4 | 25 | 50 | ○ | ○ | X | Comparison |
| 5 | 30 | 1 | ○○ | ○ | ○ | Invention |
| 6 | 30 | 5 | ○○ | ○ | ○ | Invention |
| 7 | 30 | 25 | ○○ | ○ | ○ | Invention |
| 8 | 30 | 50 | ○○ | ○ | ○ | Invention |
| 9 | 40 | 1 | ○○ | ○ | ○ | Invention |
| 10 | 40 | 5 | ○○ | ○ | ○ | Invention |
| 11 | 40 | 25 | ○○ | ○ | ○ | Invention |
| 12 | 40 | 50 | ○○ | ○ | ○ | Invention |
| 13 | 45 | 1 | ○ | X | ○ | Comparison |
| 14 | 45 | 5 | ○ | X | ○ | Comparison |
| 15 | 45 | 25 | ○ | X | ○ | Comparison |
| 16 | 45 | 50 | ○ | X | ○ | Comparison |
| 17 | 78 | 1 | ○ | X | ○ | Comparison |
| 18 | 78 | 5 | ○ | X | ○ | Comparison |
| 19 | 78 | 25 | ○ | X | ○ | Comparison |
| 20 | 78 | 50 | ○ | X | ○ | Comparison |
| 21 | 35 | 0.8 | X | ○ | ○ | Comparison |
| 22 | 18 | 10 | ○ | ○ | X | Comparison |
| 23 | 82 | 10 | X | X | ○ | Comparison |

EXAMPLE 6

(1) Preparation of samples

Aluminum alloy sheets according to JIS A5182 were primed with zinc replacement plating by a zincate method and then coated with Fe-Zn alloy platings by an electrodeposition method. Thereafter an aqueous solution of sodium tetraborate ($Na_2B_4O_7.10H_2O$) was applied to the coated samples by means of a roll coater followed by drying. The coating weight of the coating was controlled by adjusting the concentration of sodium borate.

(2) Evaluation test methods

Evaluation tests were carried out as follows, with the results shown in Table 6.

a) coating weight of inorganic compound coating

The inorganic compound coating formed on the aluminum alloy sheet was dissolved in sulfuric acid which was analyzed by ICP spectroscopy.

b) Sliding frictional property drawing test as shown in FIGS. 8*a* and 8*b*.

More particularly, the sliding frictional property of a sample was evaluated by measuring the force $D_F$ required to draw the sample with the rolls kept fixed and the force $D_R$ required to draw the sample with the rolls allowed to rotate in FIG. 8, and calculating the coefficient of friction $\mu$ of the sample from these measurements in accordance with the following formulae.

$$D_F - D_R = 2\mu p \int_0^{\pi/2} R d\theta_1 + \mu p \int_{-\pi/2}^{\pi/2} d\theta_2$$

-continued $$= 2\pi\mu pR$$

$$P_F = 2p \int_{-\pi/2}^{\pi/2} R\cos\theta_2 d\theta_2 = 2pR$$

Thus, $\mu = (D_F - D_R)/(\pi P_F)$ wherein $\mu$: coefficient of friction between roll and sample, P: force applied radially of the roll, R: roll radius, $\theta$: central angle, $P_F$: pressing load on center punch.

The test conditions are given below.

Sample size: 20×400 mm

Sliding speed: 500 mm/sec.

Sliding distance: 100 mm

Pressing load on center punch: 100 kgf

Cleaning oil: 0.5 g/m² oil application

The samples were evaluated in accordance with a coefficient of friction with the following ratings.

○: $\mu$ up to 0.12

X: $\mu$ greater than 0.12 b) Corrosion resistance

The plated aluminum alloy sheets free of phosphating and painting were subjected to a salt spray test in accordance with JIS Z2371 for 3 months before the surface oxide was removed from the samples with 30 wt % nitric acid for measuring the maximum corrosion depth. Evaluation was made in accordance with the following criterion.

○: maximum corrosion depth less than 0.1 mm

X: maximum corrosion depth 0.1 mm or more

TABLE 6

| No. | Zn content (wt %) | Coating weight (g/m²) | Inorganic compound coverage (mg/m²) | Coefficient of friction | Corrosion resistance | Remarks |
|---|---|---|---|---|---|---|
| 1 | 20 | 1 | 1000 | ○ | ○ | Invention |
| 2 | 20 | 5 | 500 | ○ | ○ | Invention |
| 3 | 20 | 25 | 10 | ○ | ○ | Invention |

TABLE 6-continued

| No. | Zn content (wt %) | Coating weight ($g/m^2$) | Inorganic compound coverage ($mg/m^2$) | Coefficient of friction | Corrosion resistance | Remarks |
|---|---|---|---|---|---|---|
| 4 | 20 | 50 | 1 | ○ | ○ | Invention |
| 5 | 50 | 1 | 1000 | ○ | ○ | Invention |
| 6 | 50 | 5 | 500 | ○ | ○ | Invention |
| 7 | 50 | 25 | 10 | ○ | ○ | Invention |
| 8 | 50 | 50 | 1 | ○ | ○ | Invention |
| 9 | 80 | 1 | 1000 | ○ | ○ | Invention |
| 10 | 80 | 5 | 500 | ○ | ○ | Invention |
| 11 | 80 | 25 | 10 | ○ | ○ | Invention |
| 12 | 80 | 50 | 1 | ○ | ○ | Invention |
| 13 | 18 | 10 | 20 | ○ | X | Comparison |
| 14 | 30 | 0.8 | 50 | X | ○ | Comparison |
| 15 | 30 | 5 | 0.8 | X | ○ | Comparison |
| 16 | 82 | 10 | 50 | X | ○ | Comparison |

INDUSTRIAL APPLICABILITY

Aluminum alloy substrates themselves are noticeably inferior in formability to steel. For improving formability, the present invention applies iron rich platings to aluminum alloy substrates. The preferred iron rich platings are Fe-Zn alloy platings having a Zn content of 20 to 80 wt %, especially 30 to 40 wt % because of their corrosion resistance improvement. By forming a zincate layer as an undercoat below the iron rich plating layer, the adhesion between the aluminum alloy substrate and the iron rich plating layer is further increased. By forming an inorganic compound layer on the iron rich plating layer, sliding frictional behavior is improved for further enhancing formability.

In this way, formability which is one of the essential drawbacks inherent to aluminum alloy sheets is improved and the present invention provides aluminum alloy sheets meeting corrosion resistance as well as formability, which will find use in automotive and other applications where sheets are press formed before use.

We claim:

1. An aluminum alloy sheet having improved formability, an elongation of at least 30%, a sliding frictional resistance of up to 0.13 and minimized surface pressure dependency of sliding frictional resistance , characterized by comprising an aluminum alloy substrate containing at least 4% by weight of Mg and a Fe rich plating layer on a surface thereof in coating weight of 1 to 50 $g/m^2$.

2. A bake hardenable, surface treated aluminum alloy sheet having improved formability, an elongation of at least 25%, a sliding frictional resistance of up to 0.13 and minimized surface pressure dependency of sliding frictional resistance, characterized by comprising a bake hardenable aluminum alloy substrate containing Mg and Si in an amount of at least 0.4 wt % calculated as $Mg_2Si$ and a Fe rich plating layer on a surface thereof in a coating weight of 1 to 50 $g/m^2$.

3. An aluminum alloy sheet having improved formability and adhesion as set forth in claim 1, characterized by further comprising a zincate layer between said aluminum alloy substrate and said Fe rich plating layer.

4. An aluminum alloy sheet as set forth in claim 1 wherein said Fe rich plating layer is a Fe-Zn alloy plating layer containing 20 to 80 wt % of Zn.

5. An aluminum alloy sheet as set forth in claim 1, wherein said Fe rich plating layer is a Fe-Zn alloy plating layer containing 30 to 40 wt % of Zn.

6. An aluminum alloy sheet having improved press formability and corrosion resistance as set forth in claim 1 characterized by further comprising an inorganic compound layer on said Fe rich plating layer.

7. An aluminum alloy sheet having improved press formability and corrosion resistance as set forth in claim 6 wherein said inorganic compound layer is formed of a hydrous alkali metal borate in coating weight of 1 to 1,000 $mg/m^2$.

8. A method for preparing a bake hardenable, surface treated aluminum alloy sheet having improved formability, an elongation of at least 25%, a sliding frictional resistance of up to 0.13 and minimized surface pressure dependency of sliding frictional resistance, characterized by comprising the steps of annealing an aluminum alloy substrate containing Mg and Si in an amount of at least 0.4 wt % calculated as $Mg_2Si$ at a temperature of at least 480° C. and forming a Fe rich plating layer in a coating weight of 1 to 50 $g/m^2$.

9. A method for preparing a bake hardenable, surface treated aluminum alloy sheet having improved formability, an elongation of at least 25%, a sliding frictional resistance of up to 0.13 and minimized surface pressure dependency of sliding frictional resistance, characterized by comprising the steps of forming a Fe rich plating layer in coating weight of 1 to 50 $g/m^2$ on an aluminum alloy substrate containing Mg and Si in an amount of at least 0.4 wt % calculated as $Mg_2Si$ and annealing at a temperature of at least 480° C.

* * * * *